US005334909A

United States Patent [19]

Kawai

[11] Patent Number: 5,334,909

[45] Date of Patent: Aug. 2, 1994

[54] MICROWAVE TUBE COLLECTOR ASSEMBLY INCLUDING A CHROMIUM OXIDE FILM

[75] Inventor: Hidemasa Kawai, Tokyo, Japan

[73] Assignee: Nec Corporation, Japan

[21] Appl. No.: 906,818

[22] Filed: Jun. 30, 1992

[30] Foreign Application Priority Data

Jul. 5, 1991 [JP] Japan ..... 3-164854
Jul. 5, 1991 [JP] Japan ..... 3-164867

[51] Int. Cl.[5] ..... H01J 23/027
[52] U.S. Cl. ..... 315/5.38
[58] Field of Search ..... 315/5.38

[56] References Cited

U.S. PATENT DOCUMENTS 2,955,225 10/1960 Sterzer ..... 315/5.38 X
4,233,539 11/1980 Falce ..... 315/5.38

FOREIGN PATENT DOCUMENTS 218739 11/1983 Japan ..... 315/5.38

OTHER PUBLICATIONS

Arthur N. Curren et al., "Textured Carbon on Copper: A Novel Surface With Extremely Low Secondary Electron Emission Characteristics" NASA Technical Paper 2543, 1985, pp. 1-14.

*Primary Examiner*—Benny T. Lee
*Attorney, Agent, or Firm*—Laff, Whitesel, Conte & Saret

[57] ABSTRACT

A microwave tube collector assembly includes a metal cylinder and a chromium oxide film. The metal cylinder has at least a layer of a chromium alloy on its overall inner circumferential surface and is closed at one end thereof. The a chromium oxide film is formed on the basis of the chromium alloy to cover the inner circumferential surface of the metal cylinder.

9 Claims, 3 Drawing Sheets

MICROWAVE TUBE COLLECTOR ASSEMBLY INCLUDING A CHROMIUM OXIDE FILM

BACKGROUND OF THE INVENTION

The present invention relates to a microwave tube collector assembly and, more particularly, to a microwave tube collector assembly having a conductive thin film on the inner circumferential surface of a metal cylinder.

A microwave tube collector assembly recovers an electron beam emitted from an electron gun. In the collector assembly, a metal cylinder is called a collector core and is closed at one end to have a bottom for directly recovering the electron beam. When the microwave tube is operated, the electron beam collides against the inner circumferential portion of the collector core. At this time, secondary electrons are emitted from the collector core. The secondary electron emission largely depends on the metal material of the collector core. In general, the average number of secondary electrons generated per electron of an incident electron beam is called a secondary electron emission ratio.

As the material of a collector core, oxygen-free copper having a high thermal conductivity is mainly used in consideration of heat generated by collision of the electron beam. However, the secondary electron emission from the oxygen-free copper causes a relatively large decrease in overall microwave tube efficiency. In addition, the secondary electrons emitted from the collector core are returned to a slow wave circuit, and the microwave tube may fail to amplify. As shown in FIGS. 5A and 5B, therefore, a coating having a low secondary electron emission ratio is formed on the inner circumferential surface of a conventional collector core to suppress secondary electron emission. In FIGS. 5A and 5B a conventional microwave tube collector assembly is shown, reference numeral 15 denotes an oxygen-free copper collector core having an outer diameter of 40 mm, a length of 120 mm, and a cylindrical recess portion having an inner diameter of 30 mm and a length of 100 mm, and reference numeral 16 denotes a carbon thin film coated on the inner circumferential surface of the oxygen-free copper collector core 15 and used for suppressing secondary electron emission. Reference numeral 17 denotes a large number of heat-radiating fins extending on the outer peripheral surface of the collector core 15 along the axial direction of the collector core 15.

In the above conventional microwave tube collector assembly, secondary electron emission from the collector core 15 is suppressed by coating a thin film consisting of carbon or the like which has a secondary electron emission ratio lower than that of an employed collector material on the inner circumferential surface of the collector core. However, since the inner circumferential portion of the collector core 15 generally has a small diameter and a large length, it is difficult to easily and uniformly coat the thin film consisting of carbon or the like on the inner circumferential surface of the collector core 15, and the large number of steps are undesirably required in this operation. In addition, when this operation is performed, the thin film 16 consisting of carbon or the like has a low adhesion strength on the inner circumferential surface of the collector core 15. For this reason, a part of the film 16 is removed during an operation of the microwave tube, thereby considerably degrading the performance of the microwave tube.

SUMMARY OF THE INVENTION

It is an object of the present invention to provide a microwave tube collector assembly capable of uniformly coating a thin film having a low secondary electron emission ratio on the inner circumferential surface of a collector core.

It is another object of the present invention to provide a microwave tube collector assembly including a thin film having a low secondary electron emission ratio and a high adhesion strength on the inner circumferential surface of a collector core.

It is still another object of the present invention to provide a microwave tube collector assembly having improved reliability.

In order to achieve the above objects, according to the present invention, there is provided a microwave tube collector assembly comprising a metal cylinder having at least a layer of a chromium alloy on an overall inner circumferential surface of the metal cylinder, the metal cylinder being closed at one end thereof, and a chromium oxide film formed on the basis of the chromium alloy to cover an inner circumferential surface of said metal cylinder.

DESCRIPTION OF THE PREFERRED EMBODIMENTS

Figure 1A:
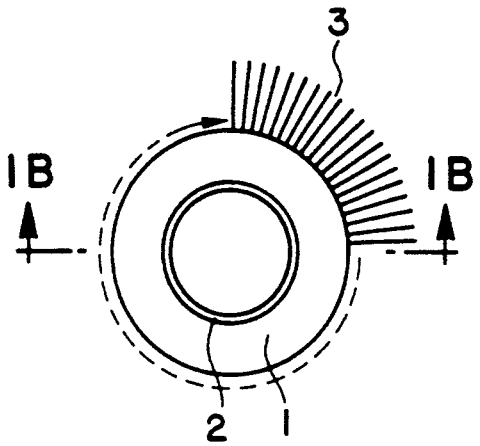
FIG. 1A is a front view showing a microwave tube collector assembly according to an embodiment of the present invention.
Figure 1B:
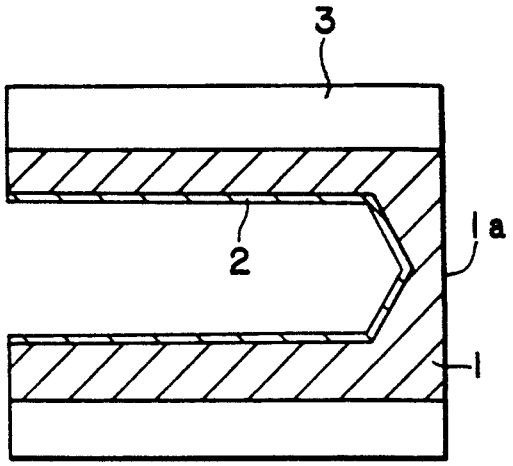
FIG. 1B is a longitudinal sectional view showing the microwave tube collector assembly along line 1B—1B of FIG. 1A.

Embodiments of the present invention will be described below with reference to the accompanying drawings. FIGS. 1A and 1B show a microwave tube collector assembly according to an embodiment of the present invention. Reference numeral 1 denotes a chromium-copper alloy collector core having an outer diameter of 40 mm, a length of 120 mm, and a cylindrical recess portion having an inner diameter of 30 mm and a length of 100 mm. The collector core 1 is closed at one end 1*a* as shown. The chromium-copper alloy contains chromium at a weight ratio of 1%. An Ni-plating layer having a thickness of 10 μm is formed on the outer peripheral surface of the chromium-copper alloy collector core 1. After the Ni-plating layer is formed, the chromium-copper alloy collector core 1 is annealed in a wet hydrogen atmosphere at 1,000° C. for 15 minutes. This annealing forms a chromium oxide thin film 2 having a thickness of about 300 Å on the inner circumferential surface of the chromium-copper alloy collector core 1. Since the chromium oxide has secondary electron emission ratio lower than that of copper or the like, it suppresses secondary electron emission. Reference numeral 3 denotes a copper heat-radiating fin having lengths 30 mm×120 mm and a thickness of 1 mm. The 80 copper heat-radiating fins uniformly extend on the outer peripheral portion of the chromium-copper alloy collector core 1 and are brazed with silver-copper alloy.

In this manner, the microwave tube collector assembly is finished. When the microwave tube collector assembly was continuously operated at 9 GHz to produce an output of 120 W, a body current was reduced to about one half that of a conventional collector assembly, and an effect to suppress secondary electron emission was confirmed. In addition, since any coating such as carbon need not be formed in the collector assembly, good operability could be obtained. Since the oxide film of the chromium-copper alloy was used, a uniform and strong film could be easily formed. Therefore, inconvenience such as removal of the film could be prevented even during an operation of the microwave tube.

Figure 2A:
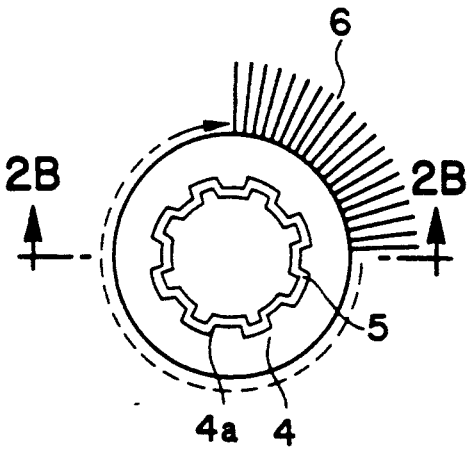
FIG. 2A is a front view showing a microwave tube collector assembly according to another embodiment of the present invention.
Figure 2B:
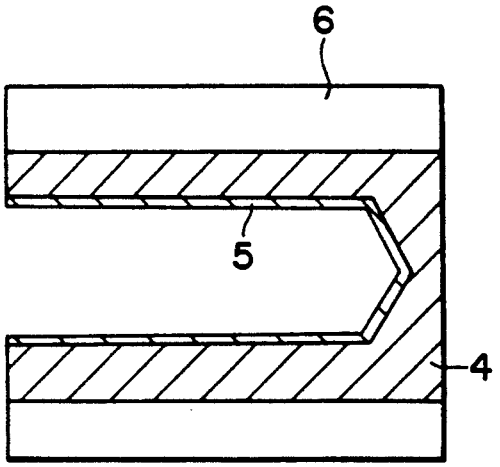
FIG. 2B is a longitudinal sectional view showing the microwave tube collector assembly taken along line 2B—2B of FIG. 2A.

FIGS. 2A and 2B show a microwave tube collector assembly according to another embodiment of the present invention. This embodiment has the same arrangement as that of the first embodiment except for the structure of a chromium-copper alloy collector core. In this embodiment, as shown in FIG. 2A, eight recess portions 4*a* each having a width of 5 mm and a length of 100 mm are uniformly formed on the inner circumferential surface of a cylindrical recess portion of a chromium-copper collector core 4 along the longitudinal direction of the recess portions 4*a*. The cylindrical recess portion has an inner diameter of 30 mm and a length of 100 mm. In this case, the chromium-copper alloy containing chromium at a weight ratio of 1% is used. An Ni-plated layer having a thickness of 10 μm is formed on the outer peripheral surface of the chromium-copper alloy collector core 4. After the Ni-plating layer is formed, the chromium-copper alloy collector core 4 is annealed in a wet hydrogen atmosphere at 1,000° C. for 15 minutes. This annealing forms a chromium oxide thin film 5 having a thickness of about 300 Å on the inner circumferential surface of the chromium-copper alloy collector core 4.

In this embodiment, since slits are formed in the inner circumferential portion of the chromium-copper collector core 4, a probability of secondary electrons emission into the inner circumferential portion of the collector core 4 is advantageously increased. The microwave tube collector assembly is finished as described above. When the microwave tube collector assembly was continuously operated at 9 GHz to produce an output of 120 W, a body current was reduced to about 2/5 that of a conventional collector assembly, and an effect to suppress secondary electron emission was confirmed. The heat radiating fins 6 are the same as the fins 3 in FIG. 1A.

In addition, since any coating such as carbon need not be formed in the collector assembly, good operability could be obtained. Since the oxide film of the chromium-copper alloy was used, a uniform and strong film could be easily formed regardless of the shape of the inner circumferential surface of the collector core. Therefore, inconvenience such as removal of the film could be prevented even during an operation of the microwave tube.

Figure 3A:
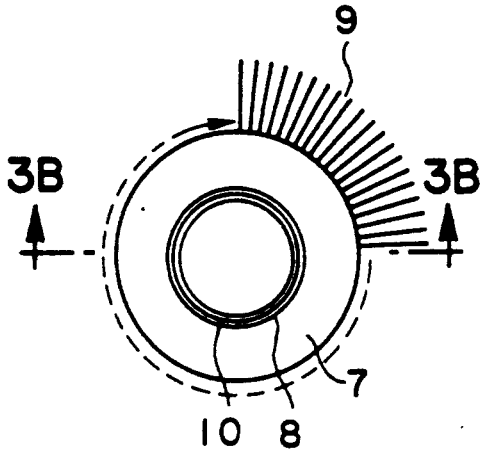
FIG. 3A is a front view showing a microwave tube collector assembly according to still another embodiment of the present invention.
Figure 3B:
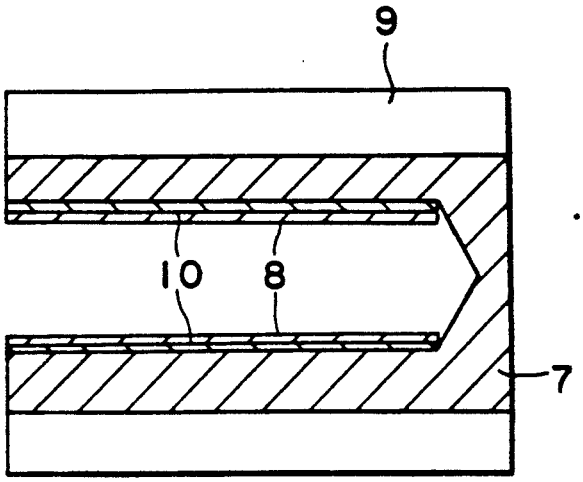
FIG. 3B is a longitudinal sectional view showing the microwave tube collector assembly taken along line 3B—3B of FIG. 3A.

FIGS. 3A and 3B show a microwave tube collector assembly according to still another embodiment of the present invention. Reference numeral 7 denotes an oxide-free copper collector core having an outer diameter of 40 mm, a length of 120 mm, and a cylindrical recess portion having an inner diameter of 30 mm and a length of 100 mm. Reference numeral 10 denotes a stainless steel (SUS304) cylinder which has an inner diameter of 28.8 mm, an outer diameter of 29.0 mm, and a length of 100 mm and inserted under pressure in the inner circumferential portion of the collector core 7. After an Ni-plating layer having a thickness of 50 μm is formed on the outer peripheral surface of the stainless steel cylinder 10, an Ag-plating layer having a thickness of 50 μm is formed on the Ni-plating layer. The oxygen-free copper collector core 7 and the stainless steel cylinder 10 are diffused and brazed in a hydrogen atmosphere using the Ag-plating layer. After the brazing is performed, this integral body is annealed in a wet hydrogen atmosphere at 650° C. for 10 minutes. This annealing forms an chromium oxide thin film 8 having a thickness of about 500 Å on the inner circumferential surface of the stainless steel cylinder 10. The heat-radiating fins are the same as fins 3 in FIG. 1A.

When the microwave tube collector assembly was continuously operated at 9 GHz to produce an output of 120 W, a body current was reduced to about one half that of a conventional collector assembly, and an effect to suppress secondary electron emission was confirmed. In addition, since any coating such as carbon need not be formed in the collector assembly, good operability could be obtained. Since the oxide film of the stainless steel (SUS304) was used, a uniform and strong film could be easily formed. Therefore, inconvenience such as removal of the film could be prevented even during an operation of the microwave tube.

Figure 4A:
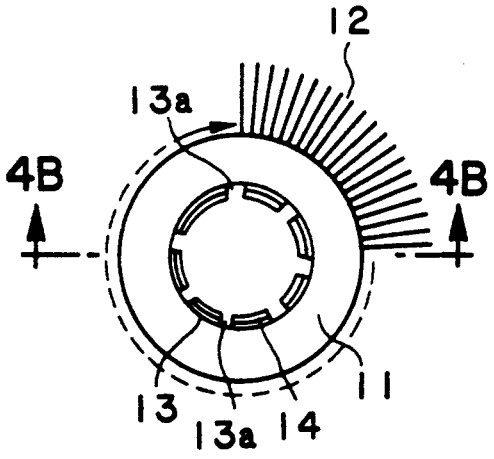
FIG. 4A is a front view showing a microwave tube collector assembly according to still another embodiment of the present invention.
Figure 4B:
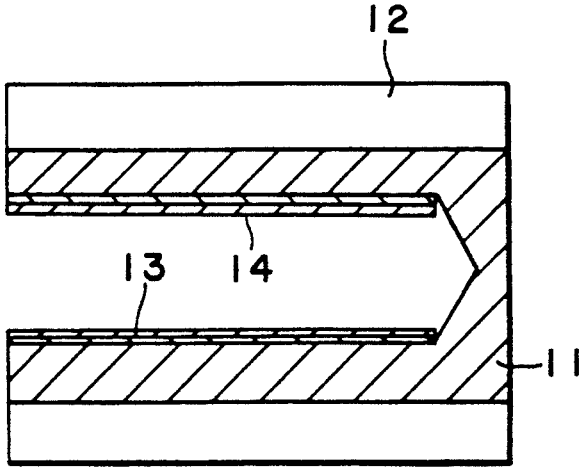
FIG. 4B is a longitudinal sectional view showing the microwave tube collector assembly taken along line 4B—4B of FIG. 4A.
Figure 5A:
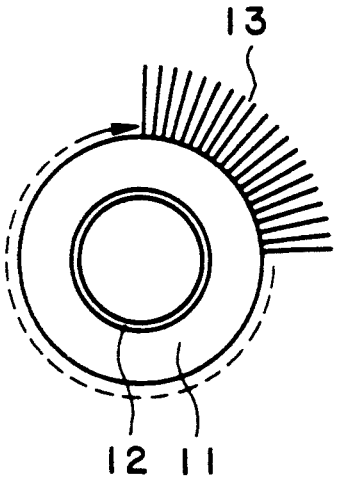
FIG. 5A PRIOR ART
FIG. 5A is a front view showing a conventional microwave tube collector assembly and FIG. 5B is a longitudinal sectional view showing the microwave tube collector assembly taken along line 5B—5B of FIG. 5A.
Figure 5B:
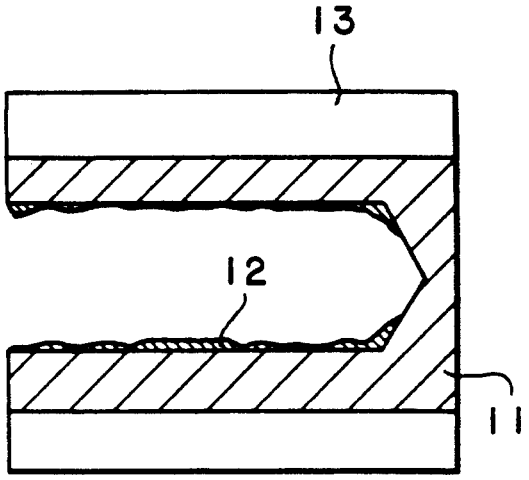
FIG. 5B PRIOR ART

FIGS. 4A and 4B show a microwave tube collector assembly according to still another embodiment of the present invention. This embodiment has the same arrangement as that of the embodiment of FIGS. 3A and 3B except for the structure of a stainless steel cylinder. Seven slits 13*a* (see FIG. 3A) each having a width of 2 mm and a length of 95 mm are uniformly formed in a stainless steel cylinder 13 having an inner diameter of 28.8 mm, an outer diameter of 29.0 mm, and a length of 100 mm. After an Ni-plating layer having a thickness of 50 μm is formed on the outer peripheral surface of the stainless steel cylinder 13, an Ag-plating layer having a thickness of 50 μm is formed on the Ni-plating layer. This stainless steel cylinder 13 is annealed in a wet hydrogen atmosphere at 1,100° C. for 15 minutes. The annealing forms an chromium oxide thin film 14 having a thickness of about 500 Å on the inner circumferential surface of the stainless steel cylinder 13 except for the portions of slits 13*a*. The microwave tube collector assembly is finished as described above. The heat radiating fins 12 are the same as the fins 3 in FIG. 1A. The collector core 11 is the same as the collector core 7. The chromium oxide thin film 14 is the same as film 8.

In this embodiment, since the slits 13*a* are formed in the stainless steel cylinder 13, the collector core metal is exposed by the slits 13*a*. For this reason, although secondary electrons are generated from the collector core metal, a heat-radiating effect is improved by the slits 13*a* because stainless steel has a thermal conductivity 20 times that of oxygen-free copper, thereby increasing the overall microwave tube efficiency. In addition, the microwave tube collector assembly was continuously operated at 9 GHz to produce an output of 120 W, a body current was reduced to about one half that of a conventional collector assembly, and an effect to suppress secondary electron emission was confirmed.

As described above, according to the present invention, a chromium oxide thin film having a low secondary electron emission ratio can be formed on the inner circumferential surface of a chromium-copper alloy collector core or on the inner circumferential surface of a stainless cylinder, thereby preventing return secondary electrons. In addition, a uniform thin film having a high adhesion strength is obtained by using an oxide film consisting of a material of the collector core or the cylinder, and the thin film is prevented from removing during an operation of the microwave tube, thereby obtaining a highly reliable microwave tube collector assembly.

What is claimed is:

1. A microwave tube collector assembly comprising:

a metal cylinder having an axial bore extent part way there through; said metal cylinder having two ends, and an inner circumferential surface within said bore, said metal cylinder being closed at one of said two ends by a termination of said bore; and a chromium oxide film covering said inner circumferential surface of said metal cylinder.

2. The assembly according to claim 1, wherein said metal cylinder is comprised of a chromium-copper alloy.

3. The assembly according to claim 2, wherein said inner circumferential surface defines a plurality of recess portions extending longitudinally through said bore.

4. The assembly according to claim 1 wherein said metal cylinder comprises a first non-chromium alloy outer cylinder and a second stainless steel inner cylinder, said first cylinder having a first cylinder inner surface and a first cylinder outer surface, said second cylinder having a second cylinder inner surface and a second cylinder outer surface, said second cylinder outer surface adhered to said first cylinder inner surface, and said chromium oxide film being on said second cylinder inner surface.

5. The assembly according to claim 4, wherein said second inner cylinder surface is defined by a plurality of slits extending longitudinally along said bore, said slits being oriented to expose portions of said first cylinder inner surface.

6. A microwave tube collector assembly comprising:

an elongated metal cylinder consisting of a chromium-copper alloy, said metal cylinder having a longitudinal axial opening with an inner surface, said metal cylinder further having an outer surface, and two ends, one of said two ends being an entrance to said longitudinal opening, the other of said two ends being closed to terminate said axial opening; and a chromium oxide film covering said inner surface.

7. A microwave tube collector assembly comprising:

a first metal cylinder with a longitudinal axially aligned opening, said first metal cylinder consisting of a non-chromium alloy, said first metal cylinder having an inner surface within said longitudinal opening, an outer surface, two ends, and said longitudinal opening ending before reaching one of said two ends whereby said opening is closed at said one end thereof;

a second stainless steel cylinder adhering to said inner surface of said first metal cylinder and said second stainless steel cylinder having an inner surface, and a chromium oxide film covering the inner surface of said second stainless steel cylinder.

8. The assembly according to claim 7 comprising a plurality of longitudinal slits in said chromium oxide film and the inner surface of said stainless steel cylinder.

9. The assembly according to claim 8 wherein said slits extend to at least the inner surface of said first metal cylinder.

* * * * *